US011299912B2

(12) United States Patent
Koya et al.

(10) Patent No.: US 11,299,912 B2
(45) Date of Patent: Apr. 12, 2022

(54) VEHICLE ELECTRONIC KEY

(71) Applicant: DENSO CORPORATION, Kariya (JP)

(72) Inventors: Takashi Koya, Kariya (JP); Koji Nakao, Kariya (JP)

(73) Assignee: DENSO CORPORATION, Kariya (JP)

( * ) Notice: Subject to any disclaimer, the term of this patent is extended or adjusted under 35 U.S.C. 154(b) by 284 days.

(21) Appl. No.: 16/509,672

(22) Filed: Jul. 12, 2019

(65) Prior Publication Data

US 2019/0338562 A1 Nov. 7, 2019

Related U.S. Application Data

(63) Continuation of application No. PCT/JP2018/001888, filed on Jan. 23, 2018.

(30) Foreign Application Priority Data

Mar. 15, 2017 (JP) ..... JP2017-050298

(51) Int. Cl.

| | |
|---|---|
| ***G07C 9/00*** | (2020.01) |
| ***E05B 47/00*** | (2006.01) |
| ***E05B 19/00*** | (2006.01) |

(52) U.S. Cl.

CPC ..... *E05B 47/0001* (2013.01); *E05B 19/00* (2013.01); *G07C 9/00309* (2013.01); *G07C 9/00571* (2013.01); *E05B 2047/0071* (2013.01); *E05B 2047/0095* (2013.01); *G07C 2009/0038* (2013.01)

(58) Field of Classification Search

CPC ... E05B 47/001; E05B 19/00; G07C 9/00309; G07C 2009/0038; B60R 25/045; B60R 25/248; B60R 25/31; G01C 21/3605

See application file for complete search history.

(56) References Cited

U.S. PATENT DOCUMENTS

2018/0208155 A1* 7/2018 Beyer ..... B60R 25/045

FOREIGN PATENT DOCUMENTS

| | | | |
|---|---|---|---|
| JP | 2002021386 | A | 1/2002 |
| JP | 2005330651 | A | 12/2005 |
| JP | 5830365 | B2 | 12/2015 |

* cited by examiner

*Primary Examiner* — Vernal U Brown

(74) *Attorney, Agent, or Firm* — Hamess, Dickey & Pierce, P.L.C.

(57) ABSTRACT

A vehicle electronic key includes: a receiver for receiving a request signal transmitted from an in-vehicle device; a transmitter for transmitting a response signal responding to the request signal; a key controller that determines whether the request signal has been received and controls the transmitter to transmit the response signal based on a determination that the request signal has been received; and an acceleration sensor that detects an acceleration applied to the vehicle electronic key and sets a vibration detection flag based on a determination that a vibration equal to or greater than a threshold value has been detected according to a detected acceleration.

4 Claims, 8 Drawing Sheets

VEHICLE ELECTRONIC KEY

CROSS REFERENCE TO RELATED APPLICATIONS

The present application is a continuation application of International Patent Application No. PCT/JP2018/001888 filed on Jan. 23, 2018, which designated the United States and claims the benefit of priority from Japanese Patent Application No. 2017-050298 filed on Mar. 15, 2017. The entire disclosures of all of the above applications are incorporated herein by reference.

TECHNICAL FIELD

The present disclosure relates to a vehicle electronic key.

BACKGROUND

An electronic key includes an acceleration sensor, and sets a response permission state based on the fact that the acceleration detected by the acceleration sensor is equal to or higher than a predetermined value. The response permission state is a state in which a response to a request signal transmitted from the vehicular device is permitted. Upon receiving the request signal in the response permission state, the electronic key transmits a response signal. A state that is not in the response permission state is defined as a response prohibition state. In the response prohibited state, the electronic key does not respond to the request signal. When a state, in which the acceleration equal to or higher than a predetermined acceleration is not detected, continues, the electronic key is in the response prohibition state. In the response prohibition state, since the electronic key does not respond to the request signal, the power consumption is reduced.

SUMMARY

In an aspect of the present disclosure, a vehicle electronic key includes: a receiver for receiving a request signal transmitted from an in-vehicle device; a transmitter for transmitting a response signal responding to the request signal; a key controller that determines whether the request signal has been received and controls the transmitter to transmit the response signal based on a determination that the request signal has been received; and an acceleration sensor that detects an acceleration applied to the vehicle electronic key and sets a vibration detection flag based on a determination that a vibration equal to or greater than a threshold value has been detected according to a detected acceleration.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
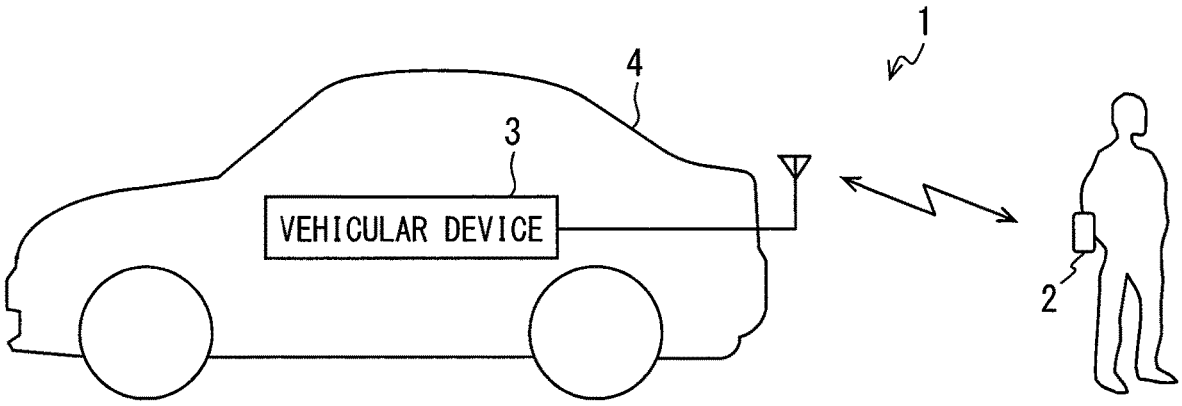
FIG. 1 is a configuration diagram of a vehicle electronic key system according to an embodiment.

An electronic key includes an acceleration sensor, and sets a response permission state based on the fact that the acceleration detected by the acceleration sensor is equal to or higher than a predetermined value. The response permission state is a state in which a response to a request signal transmitted from the vehicular device is permitted. Upon receiving the request signal in the response permission state, the electronic key transmits a response signal. A state that is not in the response permission state is defined as a response prohibition state. In the response prohibited state, the electronic key does not respond to the request signal. When a state, in which the acceleration equal to or higher than a predetermined acceleration is not detected, continues, the electronic key is in the response prohibition state. In the response prohibition state, since the electronic key does not respond to the request signal, the power consumption is reduced.

In the above key, the acceleration sensor outputs a signal indicating the detected acceleration to the electronic key control unit each time the acceleration is detected. Since the electric power is consumed when the acceleration sensor outputs the signal indicative of the acceleration to the electronic key, and the electronic key control unit recognizes the signal, it is desirable to improve the power consumption from the viewpoint of reducing power consumption.

In an aspect of the present disclosure, a vehicle electronic key includes: a receiver for receiving a request signal transmitted from an in-vehicle device mounted in the vehicle; a transmitter for transmitting a response signal responding to the request signal; a key controller that determines whether the request signal has been received based on a signal from the receiver and controls the transmitter to transmit the response signal based on a determination that the request signal has been received; and an acceleration sensor that detects an acceleration applied to the vehicle electronic key and sets a vibration detection flag based on a determination that a vibration equal to or greater than a threshold value has been detected according to a detected acceleration. The key controller reads out the vibration detection flag and sets a response permission state in response to the request signal based on a feature that the vibration detection flag is set.

According to the above-described vehicle electronic key, the acceleration sensor sets the vibration detection flag based on the detection of the vibration equal to or greater than the threshold value. Then, the key controller reads out the vibration detection flag, and sets the response permission state when the vibration detection flag is set. Every time the acceleration sensor detects acceleration, it is unnecessary to notify the detected acceleration to the key controller. Therefore, it is possible to reduce the frequency of communication between the acceleration sensor and the key controller, so that the power consumption can be reduced.

Hereinafter, embodiments of the present disclosure are described with reference to the drawings. FIG. 1 is a configuration diagram of a vehicle electronic key system 1 including a vehicle electronic key (hereinafter simply referred to as an electronic key) 2 according to the present disclosure. The vehicle electronic key system 1 includes an electronic key 2 and an in-vehicle device 3. The electronic key 2 is carried by the user, and the in-vehicle device 3 is mounted on the vehicle 4.

The vehicle electronic key system 1 conducts communication between the electronic key 2 and the in-vehicle device 3 without performing the operation of the electronic key 2 to perform code verification, and on the basis of the establishment of the code verification, the operation of the predetermined vehicle-mounted device is available. The predetermined vehicle-mounted device is, for example, a door lock mechanism provided in the door of the vehicle 4 or the like.

[Configuration of In-Vehicle Device 3]

Figure 2:
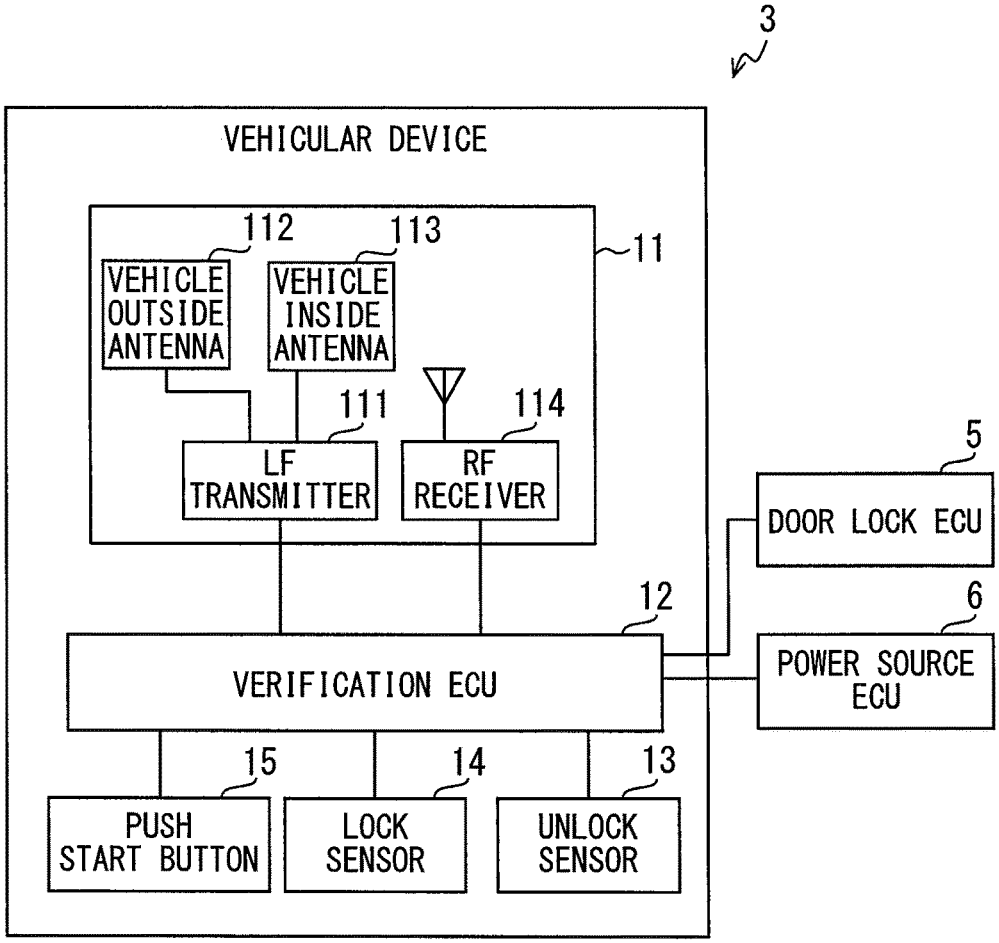
FIG. 2 is a block diagram showing the configuration of the in-vehicle apparatus of FIG. 1.

As shown in FIG. 2, the in-vehicle device 3 includes a communication unit 11, a verification ECU 12, an unlock sensor 13, a lock sensor 14, and a push start button 15.

The communication unit 11 includes an LF transmitter 111, an external antenna 112, an in-vehicle antenna 113, and an RF receiver 114. The LF transmitter 111 modulates a signal such as a request signal with a carrier wave in the LF band (for example, 135 kHz) and transmits the modulated signal from the external antenna 112 or the in-vehicle antenna 113. Determination whether the signal is transmitted from the external antenna 112 or the in-vehicle antenna 113 depends on determination what is the trigger of the signal to be transmitted. For example, when the unlock sensor 13 or the lock sensor 14 detects a user operation, the external antenna 112 is used, and when the push start button 15 is operated, the in-vehicle antenna 113 is used.

The unlock sensor 13 is installed in the door knob of the vehicle 4 or in the vicinity thereof and is a sensor that the user touches when unlocking the door of the vehicle 4. The lock sensor 14 is installed in the door knob of the vehicle 4 or in the vicinity thereof and is a sensor that the user touches when the door of the vehicle 4 is locked. The push start button 15 is a button operated by the user when setting the drive source of the vehicle 4 into the drive state or the drive permission state, and is arranged in a compartment of the vehicle 4. The drive source of the vehicle 4 is, for example, one or both of an engine or a motor.

The external antenna 112 is arranged in a door knob of the vehicle 4 or the like and transmits a radio wave to the outside of the vehicle 4. The in-vehicle antenna 113 is arranged in a compartment of the vehicle or the like, and transmits a radio wave to the inside of the vehicle 4.

When the request signal is transmitted from the external antenna 112 to the outside of the vehicle 4, the range in which the request signal can be received is about 1 meter around the vehicle 4. Upon receiving the request signal, the electronic key 2 returns a response signal with the radio wave in the RF band (for example, 315 MHz). The RF receiving unit 114 receives and demodulates the signal transmitted by the electronic key 2.

The verification ECU 12 is a computer including a CPU, a ROM, a RAM, and the like, and the CPU executes a program stored in a non-transitory tangible storage medium such as a ROM while using the temporary storage function of the RAM. As a result, the verification ECU 12 executes various controls. Note that executing the program by the CPU means that a method corresponding to the program is executed. In addition, a part or all of the functions executed by the verification ECU 12 may be configured in hardware with one or more ICs or the like.

For example, the verification ECU 12 generates a signal to be transmitted to the electronic key 2. This signal is, for example, a request signal for requesting a response to the electronic key 2. Then, the verification ECU 12 outputs the generated signal to the LF transmitter 111.

In addition, the verification ECU 12 analyzes the signal demodulated by the RF receiver 114. More specifically, it is determined whether the demodulated signal is a signal transmitted by the electronic key 2, and an ID code is included in the signal, and whether the ID code matches a proper ID code (i.e., it is determined whether verification is established).

The verification using the signal transmitted from the electronic key 2 in response to the request signal transmitted from the in-vehicle antenna 113 is defined as the compartment verification. On the other hand, the verification using the signal transmitted from the electronic key 2 in response to the request signal transmitted from the external antenna 112 is defined as the external verification. Here, the external verification is also referred as a vehicle outside verification.

The in-vehicle device 3 periodically performs the external verification in a state in which the external verification condition is satisfied, and performs the compartment verification when the compartment verification condition is satisfied. The external verification condition is, for example, both a power-off state and a door lock state. The feature that the unlock sensor 13 turns on or the feature that the lock sensor 14 turns on are also examples of the external verification condition.

As an example of the compartment verification condition, there is a condition that a predetermined operation is performed when the driver is disposed in the compartment of the vehicle. This predetermined operation is, for example, a pushing operation of the brake pedal. The operation of the push start button 15 is also an example of the predetermined operation.

The verification ECU 12 is connected to the door lock ECU 5 and the power supply ECU 6. The door lock ECU 5 detects whether the lock mechanism of the door of the vehicle 4 is in a lock state or an unlock state. Further, the lock motor and the unlock motor included in the lock mechanism are driven to switch the lock mechanism from the lock state to the unlock state or from the unlock state to the lock state. The power supply ECU 6 transmits a start request signal to an ECU that controls a drive source such as an engine.

When the external verification executed on the basis of the turning on of the lock sensor 14 is established, the verification ECU 12 outputs a signal for instructing the door lock ECU 5 to lock the lock mechanism of the door of the vehicle 4. When the compartment verification executed based on the press of the push start button 15 is established, the verification ECU 12 outputs a signal for instructing the power supply ECU 6 to start the drive source.

[Configuration of Electronic Key 2]

Figure 3:
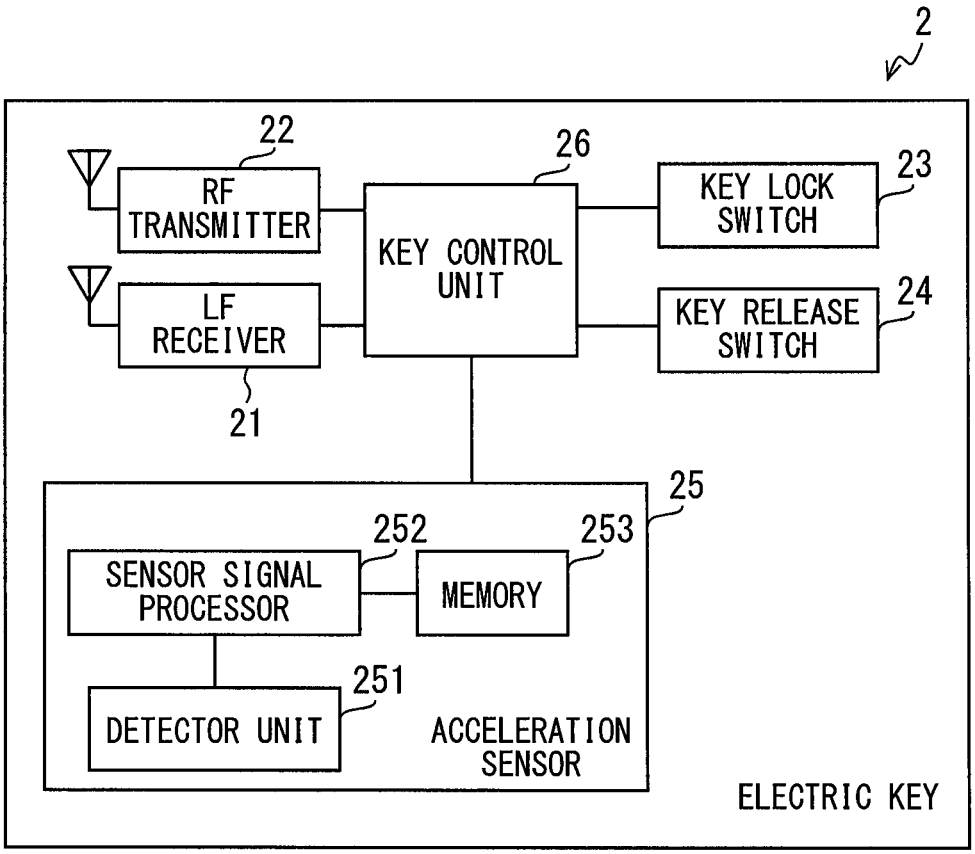
FIG. 3 is a block diagram showing the configuration of the electronic key of FIG. 1.

As shown in FIG. 3, the electronic key 2 includes an LF receiver 21, an RF transmitter 22, a lock switch 23, an unlock switch 24, an acceleration sensor 25, and a key controller 26. In addition to this, a door open/close switch, a mechanical key, etc. may be provided.

The LF receiver 21 is configured to demodulate the request signal transmitted from the in-vehicle device 3, receives the radio wave in the LF band, demodulates the radio wave, and extracts the request signal. The LF receiver 21 corresponds to a receiver.

The RF transmitter 22 modulates a signal such as a request signal generated by the key controller 26 with a carrier wave (for example, at 315 MHz) in the RF band and transmits the modulated signal. The RF transmitter 22 corresponds to a transmitter.

The lock switch 23 and the unlock switch 24 are disposed on the surface of the electronic key 2 and can be pressed by the user. The lock switch 23 is a switch that the user presses to instruct to unlock the door lock of the vehicle 4. The unlock switch 24 is a switch that the user presses to instruct to lock the door lock of the vehicle 4.

The acceleration sensor 25 includes a detection element 251, a sensor signal processing unit 252, and a memory 253. The detection element 251 is an element for detecting the acceleration applied to the electronic key 2 in which the acceleration sensor 25 is built-in. This element is, for example, an electrostatic capacitance detection type element having a sensor element movable unit and a fixed unit, and detecting a change in electrostatic capacitance therebetween. In addition, an element that detects acceleration by other methods such as a piezo resistance method may be used. It is preferable that the detection element 251 can detect acceleration in three axial directions, respectively. Alternatively, the acceleration may be detectable only in the direction of two axes or one axis.

The sensor signal processing unit 252 amplifies and adjusts the signal from the detection element 251, and outputs the acceleration detected by the detection element 251 as an electric signal. The sensor signal processing unit 252 is constituted by, for example, an ASIC. The memory 253 has a flag storage area for storing the vibration detection flag, and functions as a flag storage unit. The sensor signal processing unit 252 has an arithmetic function, and operates by selectively switching between the notification mode and the flag mode.

In the notification mode, the sensor signal processing unit 252 compares a predetermined threshold with the acceleration detected by the detection element 251, and, when determining that the vibration exceeding the threshold value has been detected, the sensor signal processing unit 252 outputs a vibration detection signal to the key controller 26. The threshold value is determined for the purpose of detecting the vibration generated in the electronic key 2 when the user carrying the electronic key 2 walks. Therefore, the magnitude of the threshold value is set to be slightly smaller than the vibration generated in the electronic key 2 when the user carrying the electronic key 2 walks.

On the other hand, in the flag mode, the sensor signal processing unit 252 compares the threshold value with the acceleration detected by the detection element 251, and sets the vibration detection flag when determining that the vibration equal to or greater than the threshold value is detected.

The key controller 26 is a computer including a CPU, a ROM, a RAM, and the like, and the CPU executes a program stored in a non-transitory tangible storage medium such as a ROM while using the temporary storage function of the RAM. As a result, the key controller 26 performs various controls. Execution of the program by the CPU means that a method corresponding to the program is executed. In addition, some or all of the functions executed by the key controller 26 may be configured in hardware by one or more ICs or the like.

The key controller 26 analyzes the received data, for example. Specifically, the signal demodulated by the LF receiver 21 is analyzed to determine whether the signal is a request signal or not. Further, the key controller 26 generates a transmission signal and outputs the generated signal to the RF transmitter 22. The generated signal is, for example, a response signal to be transmitted in response to the request signal. An ID code stored in advance is included in the response signal.

The in-vehicle device 3 has a state of periodically transmitting a request signal. In order to respond to this request signal, it is necessary to put in the reception stand-by state. The reception stand-by state is a state in which it can receive a request signal and can transmit a response signal responding to the request signal. That is, the reception stand-by state is a response permission state in which the response to the request signal is permitted.

In the reception stand-by state, since the LF receiver 21 is energized, a dark current flows. In order to reduce power consumption, the electronic key 2 can also be in a sleep state. In the sleep state, the LF receiver 21 is not energized, so that the power consumption is low. In addition, in the sleep state, since it does not respond to the request signal, it is in the response disapproval state in which the response to the request signal is not permitted.

In a state where the electronic key 2 is not carried by the user, it is considered that the electronic key 2 does not approach the vehicle 4. Also, when the electronic key 2 is carried by the user and the key 2 approaches the vehicle 4, vibration occurs in the electronic key 2. Therefore, the key controller 26 determines whether the vibration is detected, based on a signal from the acceleration sensor 25. When it is determined that the vibration is detected, it is set in the reception stand-by state.

Here, it also consumes power to transmit and receive signals between the acceleration sensor 25 and the key controller 26. Therefore, it is not preferable from the viewpoint of reducing power consumption to frequently transmit signals between the acceleration sensor 25 and the key controller 26. Therefore, in the present embodiment, when the acceleration sensor 25 detects a vibration equal to or larger than the threshold value, the vibration detection flag is set in the memory 253, and the key controller 26 reads out the feature at predetermined intervals whether the vibration detection flag is set.

[Process of Vibration Detection Flag]

Figure 4:
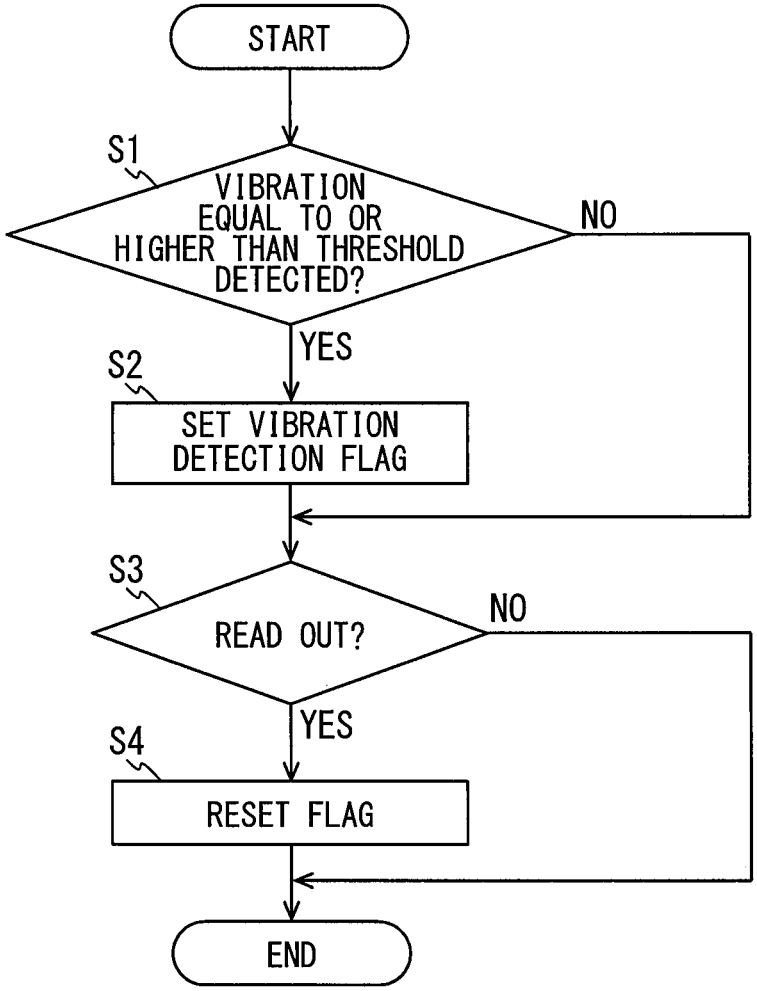
FIG. 4 is a flowchart showing a process relating to a vibration detection flag executed by the sensor signal processor of FIG. 3.

FIG. 4 is a flowchart showing the process of the sensor signal processing unit 252 related to setting and resetting of the vibration detection flag. The sensor signal processing unit 252 periodically executes the process shown in FIG. 4 in the energized state.

In the step (hereinafter, step is omitted) S1, it is determined whether a vibration equal to or larger than the threshold value is detected, based on the signal outputted from the detection element 251. When this determination is NO, the process proceeds to S3.

On the other hand, when the determination of S1 is YES, that is, when it is determined that the vibration equal to or greater than the threshold value is detected, the process proceeds to S2. In S2, a vibration detection flag is set. The setting of the vibration detection flag means that the value of the vibration detection flag stored in the flag storage area of the memory 253 is set to be 1.

When the step S2 is executed, or when the determination at S1 is NO, the process proceeds to S3. In S3, it is determined whether the vibration detection flag has been read out by the key controller 26 after the previous execution of S3. In order for the key controller 26 to read out the vibration detection flag, the key controller 26 instructs to communicate with the sensor signal processing unit 252 to output the value of the vibration detection flag. Therefore, the sensor signal processing unit 252 can determine whether the vibration detection flag has been read out.

When it is determined that the vibration detection flag has been read, that is, when the determination of S3 is YES, the process proceeds to S4. In S4, the vibration detection flag is reset, that is, 0, and the process of FIG. 4 is terminated. On the other hand, when the determination of S3 is NO, the process of FIG. 4 is terminated without executing S4. When the process of FIG. 4 is ended, the process of FIG. 4 is executed again after the execution period of the process of FIG. 4 elapses. This execution period is, for example, the same as the vibration detection cycle of the acceleration sensor 25.

[Switch Between Reception Stand-By State and Sleep State]

Figure 5:
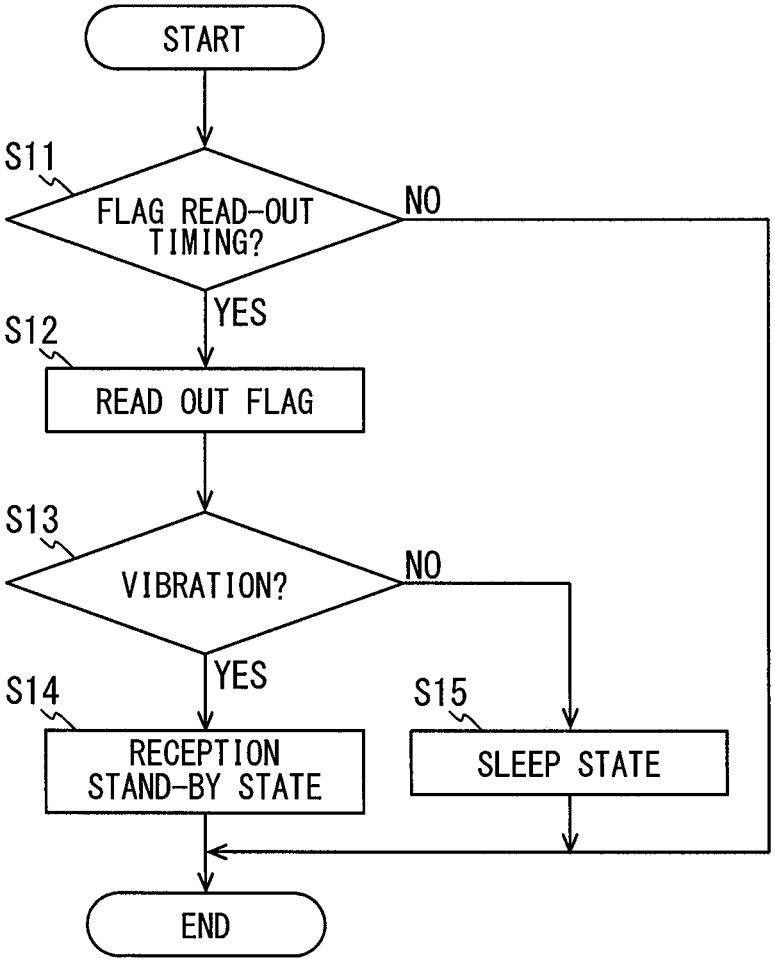
FIG. 5 is a flowchart showing a process relating to a switching operation between a reception state and a sleep state executed by the key controller of FIG. 3.

FIG. 5 is a flowchart showing the process relating to switching between the reception stand-by state and the sleep state, among the processes executed by the key controller 26. The key controller 26 periodically executes the process shown in FIG. 5 in the energized state.

In S11, it is determined whether the elapsed time since reading out the flag last time exceeds the flag reading period. The flag reading period is set to be longer than the execution cycle at which the sensor signal processing unit 252 executes the process in FIG. 4. Since this determination is made in S11, the execution period in FIG. 5 is set to be shorter than the flag read-out period.

When the determination in S 11 is NO, the process in FIG. 5 is completed. When the determination in S 11 is YES, the process proceeds to S 12. After the power supply turns on, the determination in S11 is also YES in the initial execution of FIG. 5. In S 12, the vibration detection flag is read out by communicating with the sensor signal processing unit 252 of the acceleration sensor 25. In S 13, based on the vibration detection flag read out in S 12, it is determined whether vibration has occurred. Specifically, when the vibration detection flag is 1, it is determined that vibration has occurred, and when the vibration detection flag is 0, it is determined that vibration has not occurred.

On the other hand, when the determination result at S13 is YES, the processing proceeds to S14. In S14, the reception stand-by state is set. When it is in the sleep state at the time of executing S14, the state is switched to the reception stand-by state, and when it is in the reception stand-by state at the time of executing S14, the reception standby state is continued.

When the determination of S13 is NO, the process proceeds to S15. In S15, the sleep state is set. When it is in the reception stand-by state at the time of executing S15, it is switched to the sleep state, and when it is in the sleep state at the time of executing S14, the sleep state is continued. When S14 or S15 is executed, the process of FIG. 5 is terminated.

Summary of the First Embodiment

In the first embodiment, the acceleration sensor 25 sets the vibration detection flag based on the detection of the vibration equal to or greater than the threshold value. Then, the key controller 26 periodically reads out the vibration detection flag, and sets the reception stand-by state, that is, the response permission state when the vibration detection flag is set. Every time the acceleration sensor 25 detects acceleration, it is unnecessary to notify the detected acceleration to the key controller 26. Therefore, it is possible to reduce the frequency of communication between the acceleration sensor 25 and the key controller 26, so that the power consumption can be reduced.

Second Embodiment

Next, a second embodiment will be described. In the following description of the second embodiment, the elements having the same reference numerals as those used up to now are the same as the elements of the same reference numerals in the preceding embodiments, unless otherwise mentioned. In addition, when only a part of the configuration is described, the above-described embodiment can be applied to other parts of the configuration.

In the second embodiment, the sensor signal processing unit 252 of the acceleration sensor 25 can execute to switch between the flag mode and the notification mode. The flag mode is a mode in which the vibration detection flag is set in the memory 253 when a vibration equal to or larger than the threshold value is detected. On the other hand, the notification mode is a mode for outputting a vibration detection signal, indicating that vibration exceeding the threshold value has been detected, to the key controller 26 without waiting for a request from the key controller 26.

Figure 6:
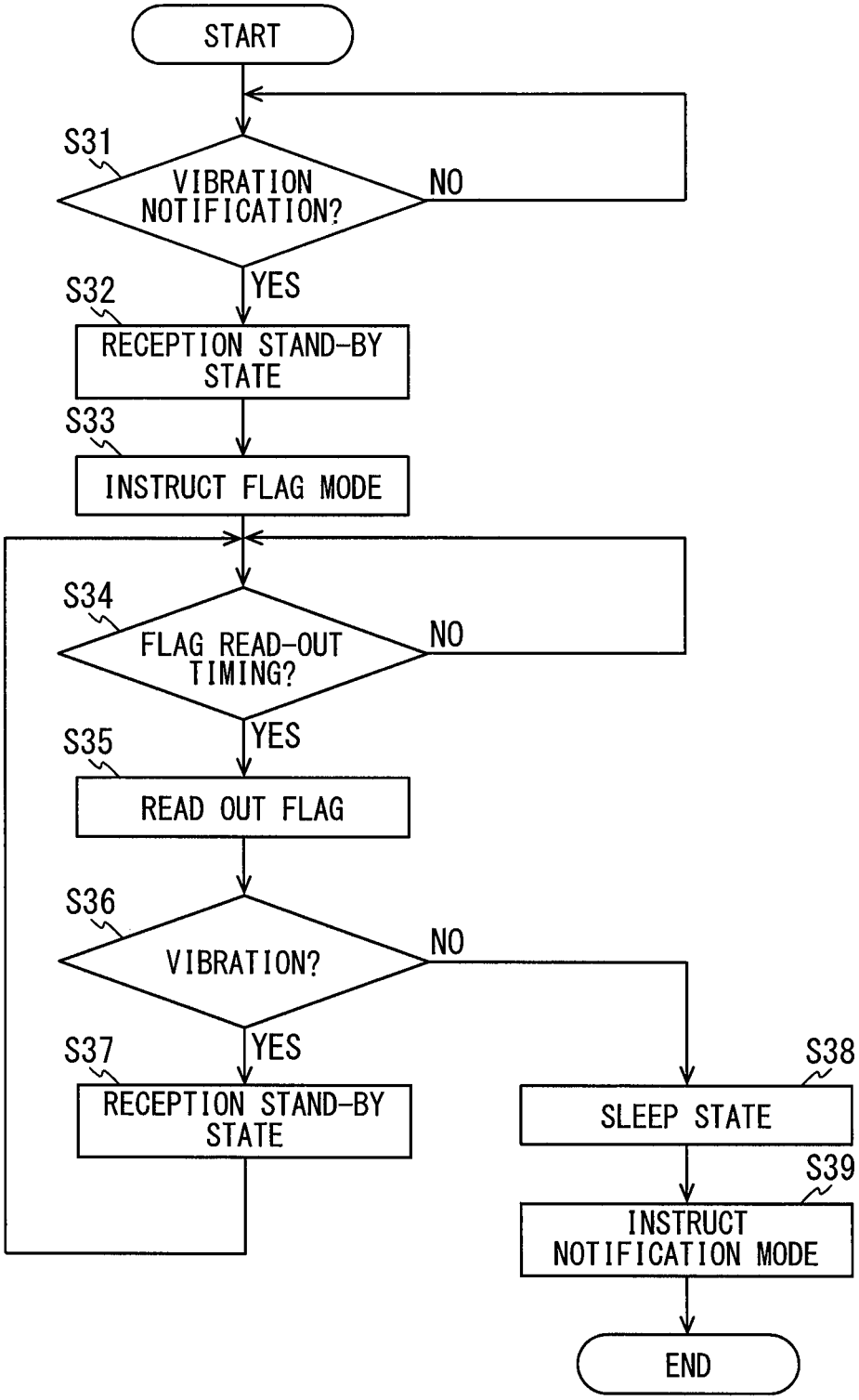
FIG. 6 is a flowchart showing a process executed by the key controller instead of FIG. 5 according to the second embodiment.
Figure 7:
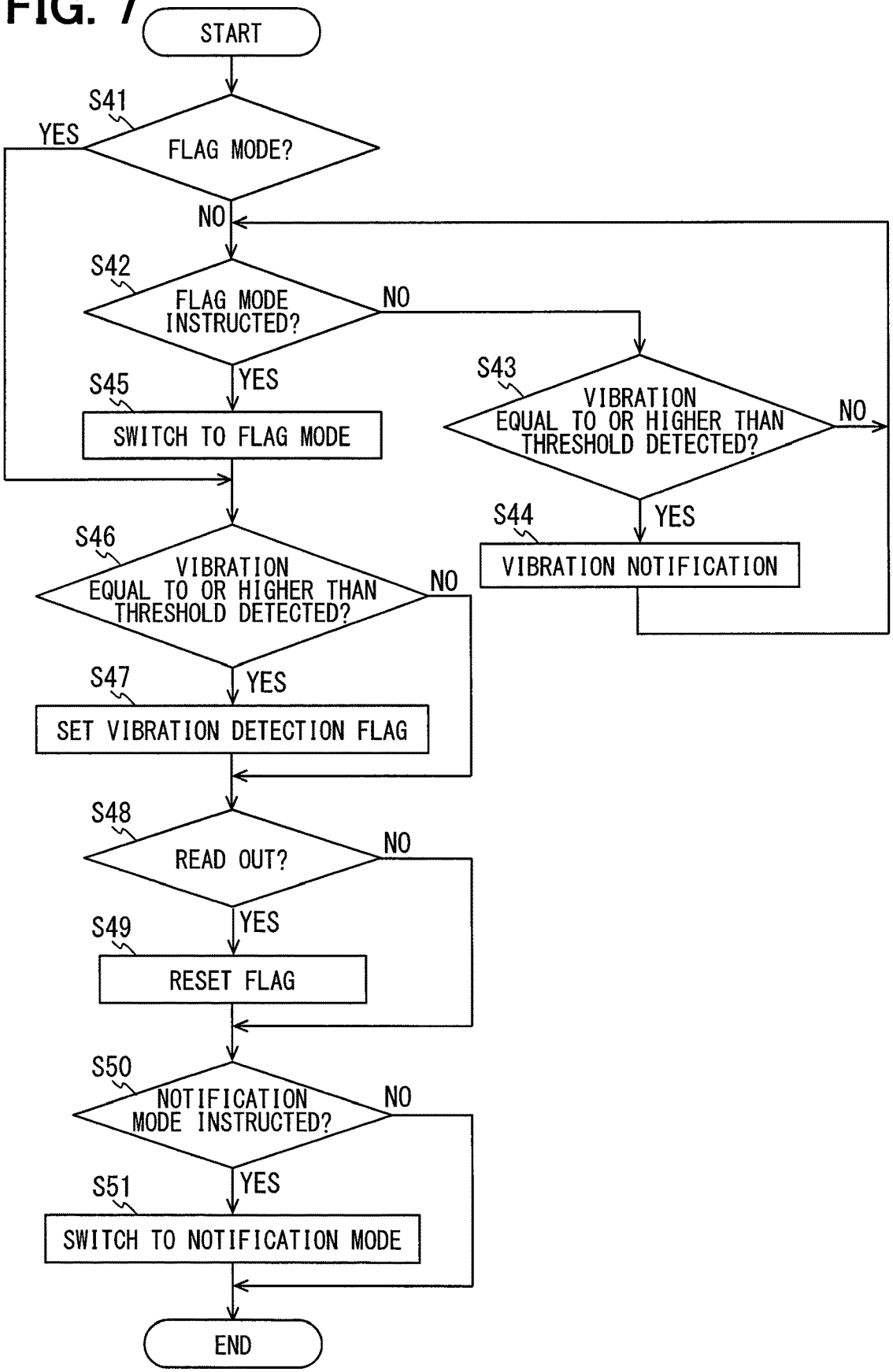
FIG. 7 is a flowchart showing a process executed by the sensor signal processor instead of FIG. 4 according to the second embodiment.

FIG. 6 is a flowchart showing process executed by the key controller 26 of the electronic key 2 in place of FIG. 5, and FIG. 7 is a flowchart showing process executed by the sensor signal processing unit 252 of the acceleration sensor 25 instead of FIG. 4. The second embodiment differs from the first embodiment in that the processes shown in FIGS. 6 and 7 are executed.

First, with reference to FIG. 6, switching process between the reception state and the sleep state executed by the key controller 26 in the second embodiment will be described. The key controller 26 repeatedly executes the process shown in FIG. 6 in the energized state. At the time of energization start, the electronic key 2 is in the sleep state.

At the start of energization, the electronic key 2 is in a sleep state. Further, when S31 is to be executed thereafter, S38 is already executed. Therefore, S31 is executed in the sleep state.

In S31, it is determined whether the acceleration sensor 25 notifies a vibration. This determination is made based on whether a vibration detection signal is acquired. When the determination of S31 is NO, S31 is repeated. On the other hand, when the determination in S 31 is YES, the process proceeds to S 32.

In S32, the state is switched to the reception stand-by state. In S33, the flag mode is instructed to the sensor signal processing unit 252. S34 to S38 are the same as S11 to S15 in FIG. 5. Therefore, when it is determined in S34 that the flag reading cycle has come, S35 is executed to read out the vibration detection flag. In S36, it is determined based on the value of the vibration detection flag whether vibration has occurred. When it is determined that vibration has occurred, the reception stand-by state is set at S37. When S37 is executed, the process returns to S34. Therefore, when it is determined that vibration has occurred, the reception waiting state is continued.

When it is determined in S36 that vibration has not occurred, the process proceeds to S38 and it switches to the sleep state. Further, S39 is executed to instruct the sensor signal processing unit 252 for the notification mode. As a result, when the acceleration sensor 25 detects a vibration equal to or larger than the threshold value, this detection is notified from the acceleration sensor 25. Then, the key controller 26 returns to S31.

Next, a process executed by the sensor signal processing unit 252 will be described. The sensor signal processing unit 252 periodically executes the process shown in FIG. 7 in the energized state. The execution period in FIG. 7 is the same as in FIG. 4. In S41, it is determined whether the mode is the flag mode. When it is the flag mode, the process proceeds to S46.

On the other hand, when it is not in the flag mode, that is, in the notification mode, the process proceeds to S42. In S42, it is determined whether switching to the flag mode is instructed from the key controller 26. When the determination of S42 is NO, the process proceeds to S43. In S43, it is determined whether a vibration equal to or greater than a threshold value is detected. The process in S43 is the same as S1 in FIG. 4. On the other hand, when the determination result at S43 is YES, the processing proceeds to S44.

In S44, in order to notify the key controller 26 that vibration has been detected, a vibration detection signal is outputted to the key controller 26. When S44 is executed, the process returns to S42. When the determination in S43 is NO, the process returns to S42 without executing S44. On the other hand, when the determination result at S42 is YES, the processing proceeds to S45. In S45, switching to the flag mode is performed. Thereafter, the process proceeds to S46.

S46 to S49 are the same as S1 to S4 in FIG. 4. Therefore, when it is determined in S46 that vibration equal to or greater than the threshold value has been detected, the vibration detection flag is set in S47. When it is determined in S48 that the vibration detection flag has been read out, the vibration detection flag is reset in S49. When the step S49 is executed, or when the determination at S48 is NO, the process proceeds to S50.

In S50, it is determined whether the key controller 26 instructs to switch to the notification mode. When the determination result at S50 is YES, the processing proceeds to S51. In S51, the mode is switched to the notification mode. Thereafter, the process of FIG. 7 is terminated. On the other hand, when the determination of S50 is NO, the process of FIG. 7 is terminated without executing S51.

Next, in the second embodiment, the acceleration sensor 25 outputs a vibration detection signal to the key controller 26 when it is detected that the vibration is equal to or larger than the threshold value in the notification mode. Upon acquiring the vibration detection signal, the key controller 26 sets the reception stand-by state (at S32).

In the sleep state, it can not respond to the request signal transmitted by the in-vehicle device 3. Therefore, when the electronic key 2 is disposed at a position where the request signal can be received, and the sleep state is set although it is necessary to respond to the request signal, the responsiveness to the request signal is reduced. In order to restrict the reduction of the responsiveness, when the vibration is detected, the electronic key 2 shifts to the reception stand-by state.

Since the vibration detection signal is a signal for setting the reception stand-by state, when the reception stand-by state has already been established, the necessity for the key controller 26 to promptly acquire the vibration detection signal is low. Therefore, when the key controller 26 is set in the reception stand-by state, the key controller 26 executes S33 to set the acceleration sensor 25 in the flag mode.

That is, in the second embodiment, the key controller 26 sets the acceleration sensor 25 in the flag mode in a situation where it is unnecessary to quickly grasp that the vibration equal to or greater than the threshold has occurred, so that it is possible to restrict the reduction of the response with respect to the key signal and to reduce the power consumption. On the other hand, in the sleep state, the key controller 26 sets the acceleration sensor 25 in the notification mode. As a result, when the user brings up the electronic key 2, the electronic key 2 immediately enters into the reception stand-by state. Thereafter, while the electronic key 2 is being carried by the user and moves, the reception stand-by state continues in the electronic key 2, so that it is possible to quickly respond to the request signal.

Third Embodiment

Figure 8:
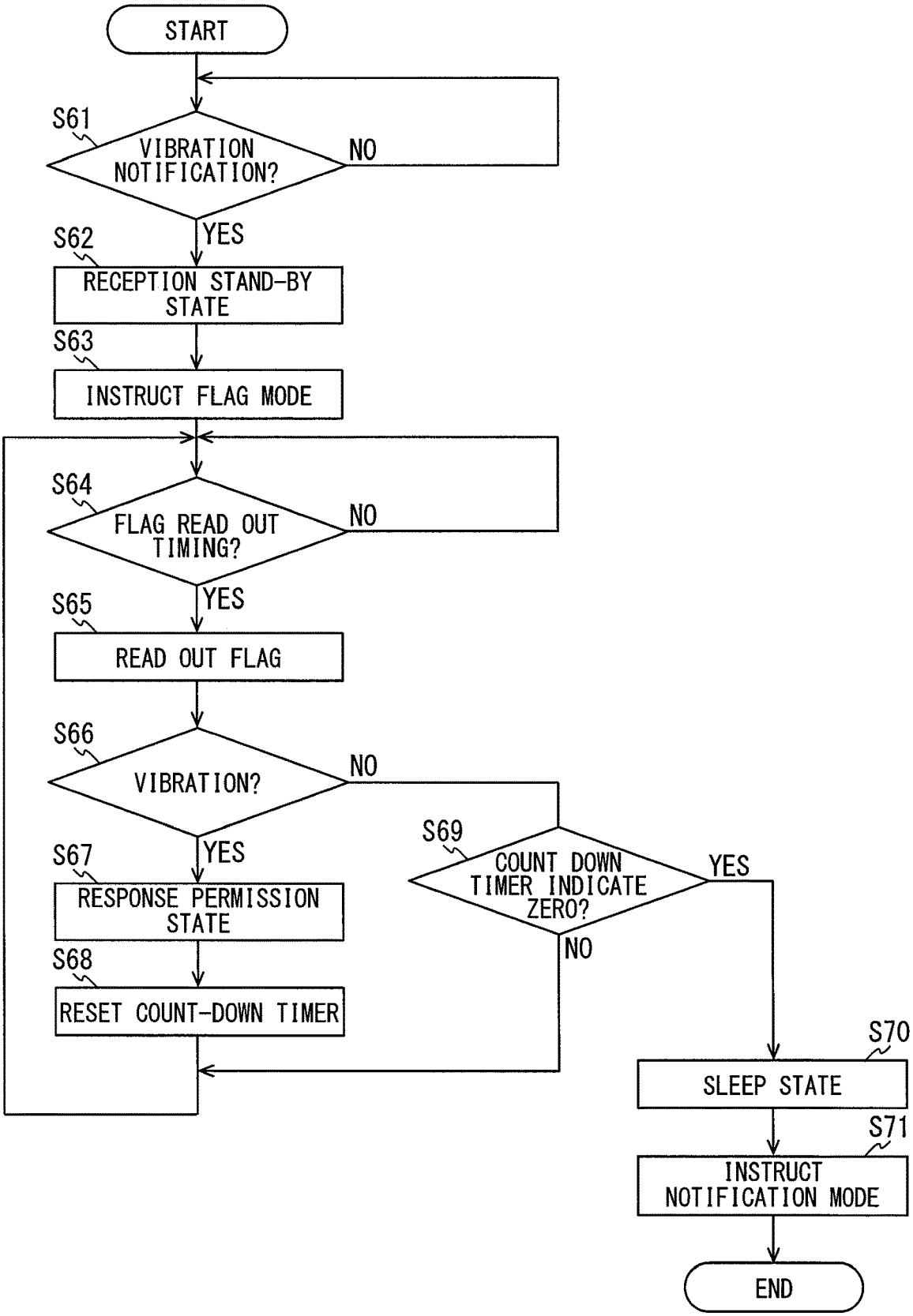
FIG. 8 is a flowchart showing a process executed by the key controller instead of FIG. 5 according to the third embodiment.

In the third embodiment, instead of the process shown in FIG. 6, the process shown in FIG. 8 is executed. In FIG. 8, S61 to S67 execute the same processes as S31 to S37 of FIG. 6. After S67 is executed, S68 is executed. In S68, the countdown timer is reset. This countdown timer is used to judge whether the time during which no vibration is detected has continued for a certain period of time. Therefore, when it is determined that there is vibration in S66, the countdown timer is reset to the initial value. The initial value of the countdown timer is set to be longer than the flag read-out cycle, for example, several minutes. The initial value of the countdown timer corresponds to the minimum duration time.

When the determination at S66 is NO, that is, when it is determined that vibration is not detected, the process proceeds to S69. In S69, it is determined whether the countdown timer has become 0. This determination is made to judge whether the time during which the acceleration sensor 25 continues to detect the vibration equal to or greater than the threshold exceeds the minimum duration time.

When the determination in S69 is YES, steps S70 and S71 are executed. S70 and S71 are the same as S38 and S39 in FIG. 6, respectively. In S70, the state is shifted to the sleep state, and in S71, the notification mode is instructed to the sensor signal processing unit 252.

When the determination in S69 is NO, the process returns to S64 without executing S70 and S71. Therefore, when the countdown timer has not become 0, even if it is determined that there is no vibration at S66, it will not shift to the sleep state.

In the third embodiment, the key controller 26 reads out the vibration detection flag, and does not immediately instruct the acceleration sensor 25 to switch to the notification mode even when it determines that vibration has not been detected. The key controller 26 instructs the acceleration sensor 25 to switch to the notification mode when the time during which the vibration has not been detected continues for the time determined as the initial value of the countdown timer.

This also reduces the frequency of instructing to switch to the notification mode. Since power is consumed even when instructing to switch to the notification mode, the frequency of instructing to switch to the notification mode is reduced, so that the power consumption can be further reduced.

In the notification mode, no communication between the acceleration sensor 25 and the key controller 26 is performed unless vibration of a threshold value or more occurs. Therefore, in a situation where there is a high possibility that vibration does not occur, it is possible to reduce power consumption using the notification mode. However, with the degree that the vibration has not occurred during the flag read-out period, it is a state where the user temporarily stops, and therefore, there is a high possibility that the vibration will occur again.

Therefore, in the third embodiment, when the time during which the vibration has not been detected continues for the time determined as the initial value of the countdown timer, the acceleration sensor 25 is instructed to switch to the notification mode. As a result, the number of times of communication between the acceleration sensor 25 and the key controller 26 is reduced, and the power consumption can be further reduced.

Fourth Embodiment

The fourth embodiment is an improvement of the third embodiment, and when it is determined that the electronic key 2 is inside the passenger compartment of the vehicle 4 and when it is determined that there is a possibility that the electronic key 2 has been taken out of the vehicle, the initial value of the countdown timer is changed. In order to change the initial value of the countdown timer, in the fourth embodiment, the key controller 26 executes the process shown in FIG. 9 and FIG. 10 in addition to the process described in the third embodiment.

Figure 9:
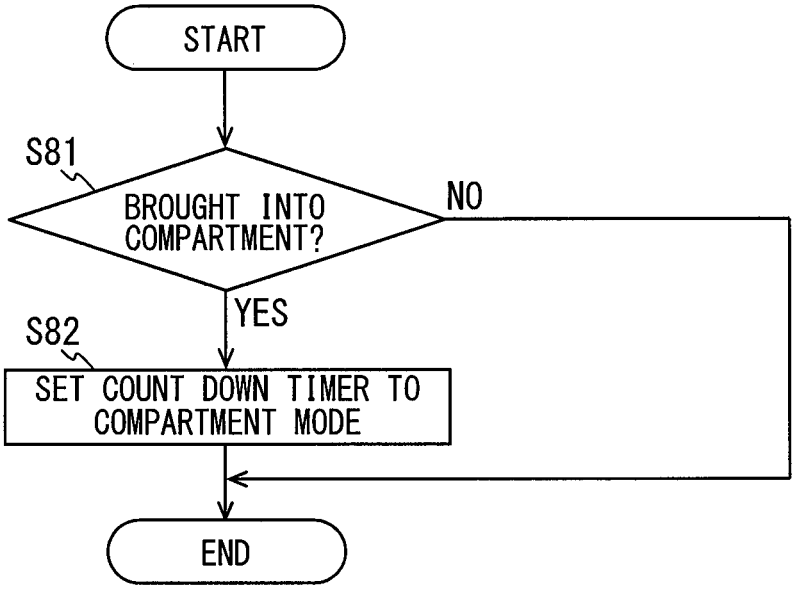
FIG. 9 is a flowchart showing a process executed by the key controller instead of FIG. 8 according to the fourth embodiment.

The process in FIG. 9 is periodically executed in a state in which it is determined that the electronic key 2 is disposed outside the vehicle 4. In S81, it is determined whether the electronic key 2 has been brought into the compartment of the vehicle 4. This determination itself is directly performed by the in-vehicle device 3, and the determination result is acquired from the in-vehicle device 3 by communication.

Various methods are known for the in-vehicle device 3 to determine whether the electronic key 2 has been brought into the vehicle compartment of the vehicle 4. For example, it is determined that the electronic key 2 has been brought into the passenger compartment of the vehicle 4 when the door of the vehicle 4 is closed after the door of the vehicle 4 is opened and after the external verification is established.

When the determination of S81 is NO, the process of FIG. 9 is terminated without executing S82. On the other hand, when the determination in S81 is YES, the process proceeds to S 82. In S82, the initial value of the countdown timer is set to a value for when the electronic key 2 is brought into the passenger compartment, hereinafter referred to as a passenger compartment initial value. The initial value used when the electronic key 2 is outside the vehicle, compared with the passenger compartment initial value, is set as the external initial value.

The passenger compartment initial value is longer than the external initial value. Specifically, for example, the external initial value is several minutes, whereas the passenger compartment initial value is several hours. Several hours are an example, and the specific time can be changed as appropriate.

The reason for lengthening the external initial value is to establish the compartment verification. As described above, the in-vehicle device 3 carries out the compartment verification when the compartment verification condition is satisfied. When the compartment verification is carried out, and when the electronic key 2 is disposed in the passenger compartment, it is necessary to establish the compartment verification to be succeeded. In order for establishing the compartment verification to be succeeded, it is necessary for the electronic key 2 to be in the reception stand-by state.

In the case of using the countdown timer described in the third embodiment, the time interval during which the reception stand-by state is available is a period until the countdown timer becomes 0 after the acceleration sensor 25 finally detected the vibration having the threshold value or more. The frequency with which the acceleration sensor 25 detects the vibration equal to or larger than the threshold value while the electronic key 2 is brought into the passenger compartment is less than a frequency in a case where the user carries the electronic key 2, such as the frequency when the vehicle 4 travels on a bumpy road. Therefore, when it is determined that the electronic key 2 has been brought into the passenger compartment of the vehicle 4, the initial value of the countdown timer is set to the compartment initial value, which is longer than the external initial value.

Figure 10:
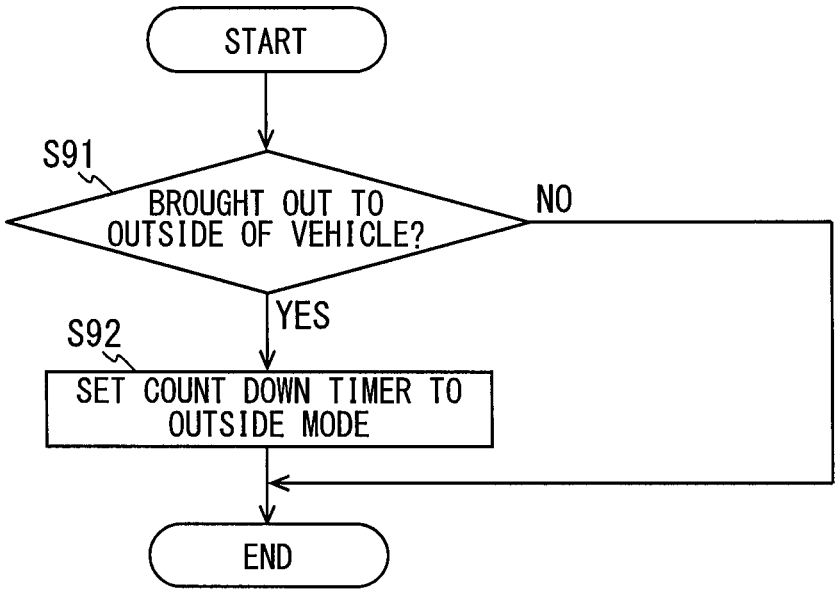
FIG. 10 is a flowchart showing a process executed by the key controller in addition to FIG. 8 and FIG. 9 according to the fourth embodiment.

In a situation where it is determined that the electronic key 2 has been brought into the passenger compartment, the process in FIG. 10 is executed instead of FIG. 9. In S91, it is determined whether the electronic key 2 has been brought out of the vehicle 4. This determination is directly performed by the in-vehicle device 3, and the determination result is acquired from the in-vehicle device 3 by communication.

Various methods are also known for the in-vehicle device 3 to determine whether the electronic key 2 has been brought out of the vehicle 4. For example, when the door of the vehicle 4 is opened in a situation where it is determined that the electronic key 2 is inside the vehicle compartment, it is determined that the electronic key 2 has been taken out of the vehicle 4.

It should be noted that there is a merely possibility that the electronic key 2 will be brought out of the vehicle only when the door of the vehicle 4 is opened in a situation where it is determined that the electronic key 2 is inside the vehicle compartment. When there is a possibility that the electronic key 2 will be brought out of the vehicle, the in-vehicle device 3 performs the external verification. A condition for determining that the electronic key 2 has been brought out of the vehicle may be a feature that the external verification has been established or a feature that the external verification has been established after the opened door is closed.

When the determination of S91 is NO, the process of FIG. 10 is terminated without executing S92. On the other hand, when the determination in S91 is YES, the process proceeds to S92. In S92, the initial value of the countdown timer is set to the external initial value.

In the fourth embodiment, as in the third embodiment, the number of times of communication between the acceleration sensor 25 and the key controller 26 can be reduced. In addition, it is possible to reduce the possibility that the compartment verification will not be established.

Although the embodiments of the present disclosure have been described above, the present disclosure is not limited to the above-described embodiments, and the following modified examples are also included in the technical scope of the present disclosure, and furthermore, various changes can be made within the range that does not deviate from the scope.

First Modified Example

In the above-described embodiment, in the notification mode, the acceleration sensor 25 outputs a vibration detection signal to the key controller 26 when a vibration of a threshold value or more is detected. Alternatively, in the notification mode, the acceleration sensor 25 may sequentially output a signal indicating the magnitude of the detected acceleration to the key controller 26 regardless of the magnitude of the detected acceleration.

It is noted that a flowchart or the processing of the flowchart in the present application includes sections (also referred to as steps), each of which is represented, for instance, as S1. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A vehicle electronic key comprising:

a receiver configured to receive a request signal transmitted from an in-vehicle device mounted on a vehicle, and to output a signal in response to receiving the request signal;

a transmitter configured to transmit a response signal to the in-vehicle device;

a key controller configured to determine whether the request signal is received based on the signal output by the receiver, and to control the transmitter to transmit the response signal in response to determining that the request signal is received; and an acceleration sensor configured to detect an acceleration applied to the vehicle electronic key, to determine whether the detected acceleration is greater than or equal to a predetermined threshold, and to set a vibration detection flag in response to determining the detected acceleration is greater than or equal to the predetermined threshold, the acceleration sensor configured to perform the detecting and determining at every vibration detection cycle, wherein:

the key controller is further configured to read out the vibration detection flag at every flag read-out cycle, to determine whether the vibration detection flag is set, and to set a response permission state in response to determining the request signal is received and the vibration detection flag is set, and the flag read out cycle of the key controller is longer in duration than the vibration detection cycle of the acceleration sensor.

2. The vehicle electronic key according to claim 1, wherein:

the acceleration sensor is further configured to execute a flag mode and a notification mode, and to switch between the flag mode and the notification mode;

the flag mode being a mode in which the vibration detection flag is set in response to detecting that the vibration is greater than or equal to the threshold value;

the notification mode being a mode in which a vibration detection signal is output to the key controller in response to detecting that the vibration is greater than or equal to the threshold value, the vibration detection signal indicating a detection of the vibration greater than or equal to the threshold value; and the key controller is further configured to set the response permission state in response to acquiring the vibration detection signal, and to instruct the acceleration sensor to set the flag mode.

3. The vehicle electronic key according to claim 2, wherein:

the key controller is further configured to instruct the acceleration sensor to set a response disapproval state which does not respond to the request signal, to set the notification mode in response to the vibration detection flag not being set, to set a duration of a time interval to a minimum duration time for determining whether the vibration detection flag has been read out and whether the detected acceleration is greater than or equal to a predetermined threshold, and to determine whether the duration of the time interval has elapsed.

4. The vehicle electronic key according to claim 3, wherein:

the key controller is further configured to determine whether the vehicle electronic key is brought into the compartment of the vehicle, to determine whether the duration of the time interval has increased, and to determine whether the vehicle electronic key exits the compartment of the vehicle;

in response to determining that the vehicle electronic key is brought into the compartment of the vehicle, the key controller is further configured to set the duration of the time interval to be longer than the minimum duration time; and in response to determining that the vehicle electronic key exits the compartment of the vehicle after increasing the duration of the time interval to be longer than the minimum duration time, the key controller is further configured to set the duration of the time interval to the minimum duration time.

* * * * *